United States Patent [19]

Sanford et al.

[11] Patent Number: 4,648,448

[45] Date of Patent: Mar. 10, 1987

[54] PACKER ASSEMBLY

[75] Inventors: Lawrence Sanford, Houston; Charles O. Stokley, Sugar Land; Edwin C. Turner, Houston, all of Tex.

[73] Assignee: Tam International, Inc., Houston, Tex.

[21] Appl. No.: 684,006

[22] Filed: Dec. 20, 1984

[51] Int. Cl.[4] ..... E21B 33/127

[52] U.S. Cl. ..... 166/191

[58] Field of Search ..... 166/183, 184, 185, 187, 166/188, 191, 150, 152, 387

[56] References Cited

U.S. PATENT DOCUMENTS

| | | | |
|---|---|---|---|
| 3,012,611 | 12/1961 | Haines | 166/191 |
| 3,529,665 | 9/1970 | Malone . | |
| 3,606,924 | 9/1971 | Malone . | |
| 4,185,689 | 1/1980 | Harris | 166/188 |
| 4,453,599 | 6/1984 | Fredd | 166/150 |
| 4,458,752 | 7/1984 | Brandell | 166/191 |

FOREIGN PATENT DOCUMENTS

| | | |
|---|---|---|
| 1441131 | 6/1976 | United Kingdom . |
| 1505194 | 3/1978 | United Kingdom . |

*Primary Examiner*—Stephen J. Novosad
*Assistant Examiner*—William P. Neuder
*Attorney, Agent, or Firm*—Browning, Bushman, Zamecki & Anderson

[57] ABSTRACT

A downhole packer assembly includes a first packer tool with a flexible tubular packer body which is radially extendable by virtue of fluid pressure in a packer set chamber. A generally annular packer foundation, including an upper packer head, is connected to the upper end of the packer body. The tool defines a bypass flow system for permitting flow of fluid from the packer set chamber to a central longitudinal flowway of the assembly and from this central flowway to the exterior of the assembly. A control sub adjacent the packer foundation is movable with respect to the packer foundation between a first position, for opening the bypass system, and a second position, closing the bypass system. The control sub is preferably further operative, in its first position, to permit communication between the central flowway and the packer set chamber, and in its second position, to close the packer set chamber. A second packer tool is connected in tandem with the first tool. A ported cylinder is communicatively connected to the packer foundations generally below the locus of the control sub and has a piston reciprocably disposed therein and sealed with respect thereto, the piston being yieldably urged toward the control sub. A plug ejector may be adjoined to the upper packer head of the first tool and disposed therein but adapted to permit flow therethrough. The plug ejector has a free end extending upwardly and positioned for telescopic movement with respect to the lower end of the control sub as it moves between its inflation and set positions.

37 Claims, 11 Drawing Figures

FIG. 2
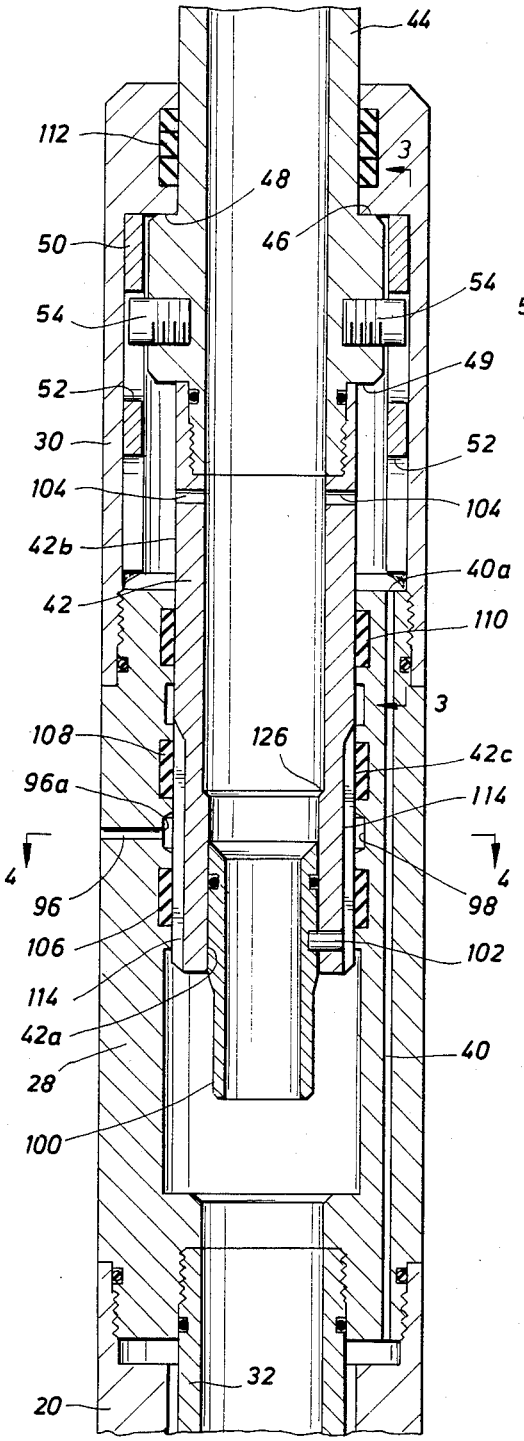
FIG. 3
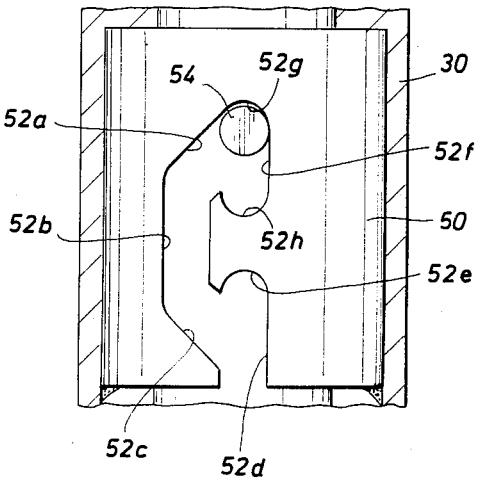
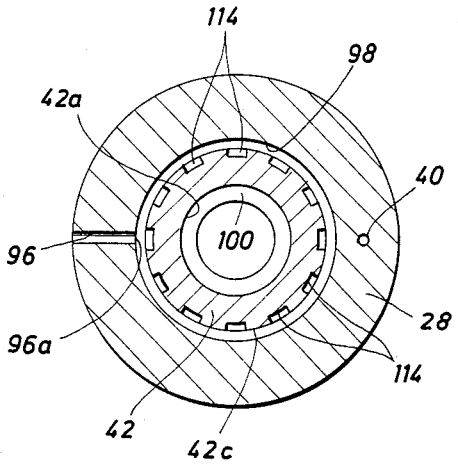
FIG. 4

PACKER ASSEMBLY

BACKGROUND OF THE INVENTION

1. Field of the Invention

The present invention pertains to downhole packer tool assemblies, and more particularly, to assemblies comprising the type of packer tool which includes a flexible tubular packer body which is radially extended and retracted with respect to a well bore wall by fluid pressure in a packer set chamber. The features of the invention are particularly advantageous for use in packer assemblies wherein the packer body is of the inflatable type, although the invention may also be used in other types of packers. Likewise, while certain features of the invention are particularly suitable for use in assemblies including two packer tools connected in tandem, at least some of the features of the present invention may likewise be used with assemblies including only a single packer tool.

2. Description of the Prior Art

A modern inflatable packer generally comprises, in addition to the packer body per se, a generally annular upper packer head which is connected to the upper end of the packer body. A tubular mandrel may be connected to the packer head and extends coaxially through the interior of the packer body and out through its lower end. The lower end of the packer body is connected to an annular lower packer head which is slidably disposed in coaxially surrounding relation to the mandrel and sealed with respect thereto.

Thus, an inflation or packer set chamber is defined in the annular space between the mandrel and the interior of the packer body. Some type of inlet is generally provided in the upper packer head in communication with this packer set chamber. The lower end of the mandrel is either closed, or adapted to be selectively closed, as by pumping a suitable plug down through the operating string on which the tool is suspended until it seats on a shoulder provided in the lower end of the mandrel. Then, fluid pressure can be introduced through the operating string to the inlet system in the upper packer head, and thence to the packer set chamber, so as to inflate the packer body.

To accommodate the radial extension of the packer body during such inflation, the lower packer head may slide upwardly on the mandrel. In general, such a tool is likewise provided with some means of setting the packer, i.e. locking it in the inflated condition so that there is no need to maintain pressure in the operating string.

The features described thus far are generally common to all sorts of inflatable packers. More specifically, inflatable packers may, for purposes of the present discussion, be considered as divided into two types. The first type is sometimes called a "multi-set packer." With such a packer, the packer body, once inflated and set, can be released or deflated and subsequently re-inflated and reset downhole, i.e. without being removed from the well for redressing or the like. Prior art multi-set packers have generally been designed so that, when they are released downhole, the fluid in the packer set chamber is emptied into the interior of the packer mandrel and/or the adjoining operating string. This limits the applicability of such mutli-set packers; they are very difficult to use in certain situations, such as those in which the operating string or tubing stands full of liquid, but the annulus between the operating string and the well bore wall is not full. The difficulty of emptying the fluid within the packer set chamber into the interior of the operating string or tubing under such circumstances can readily be appreciated.

The other major general type of inflatable packer is commonly known as a "single set packer." In general, prior art single set packers have been usable in the aforementioned situations which are not well suited for conventional multi-set packers. This is because a single set packer typically may be released downhole by emptying the contents of the packer set chamber into the annulus between the operating string and the well bore wall. Thus, the tool can easily be released even if the operating string stands full of liquid. However, typical prior art single set packers suffer from the disadvantage, implied by their name, that they cannot be reinflated and reset downhole. Thus, once a single set packer has been released, a trip to the surface is necessary before the well bore can be once again packed off.

SUMMARY OF THE INVENTION

The present invention provides the advantages of a multiset packer in that it can be released and reset downhole any number of times. However, the assembly of the present invention further provides advantages usually associated with single set packers in that, when it is released, the fluid which is emptied from the packer set chamber may, when necessary, flow into the annulus. Thus, the present invention can be used in many situations unsuitable for prior art multi-set packers.

To accomplish this, the present invention is designed so that fluid being released from the packer set chamber, although initially directed into the interior of the tool and its operating string, may utlimately flow to the annulus through a bypass system which is provided within the tool.

More specifically, a downhole packer assembly according to the present invention includes at least first packer tool defining a central longitudinal flowway. The tool comprises a flexible tubular packer body, means defining a packer set chamber for that body, and a generally tubular packer foundation preferably comprising an annular upper packer head connected to the upper end of the packer body and a mandrel extending through the packer body. The tool defines a bypass flow system which allows for fluid flow from the packer set chamber to the exterior of the assembly. A control means is movable relative to the packer foundation between first and second positions, opening and closing the bypass system, respectively. In addition to opening and closing the bypass, the first and second positions of the flow control means serve to open and close the packer set chamber to communication with the central flowway.

Even more specifically, the upper packer head defines a chamber inlet for the packer set chamber. The upper packer head further has a bypass passageway extending generally radially therethrough, and this bypass passageway is isolated from direct communication with the packer set chamber. The bypass passageway has a radially inner opening longitudinally spaced from the chamber inlet.

The flow control means is annular and is disposed at least partially telescopically within the upper packer head for relative longitudinal movement between the first or "inflation-deflation" position and the second or "set" position. This control means has a closable zone, preferably in its lower end, which is adapted for cooperation with releasable closure means, and also has an inflation port extending generally radially therethrough and spaced above said closable zone. The control means also has a bypass area, preferably its lower end, which forms a part of the aforementioned bypass system.

Seal means are provided for cooperation between the upper packer head and the control means. The seal means is operative, in the first position, to permit fluid communication between the inflation port and the chamber inlet, and also to permit fluid communication between the bypass area of the control means and the radially inner opening of the bypass passageway. In addition, in this position, the seal means seals between the upper packer head and the control means between the chamber inlet and the radially inner opening of the bypass passageway. Thus, if the closable zone of the control means is closed by a suitable plug or the like, and fluid is pumped into the operating string, the seal means prevent such fluid from flowing from the inflation port to the bypass passageway, while the closure in the lower end of the control means will prevent the fluid from flowing through the lower end of the control means and thence to the bypass passageway. The only flow path available for such fluid will be through the inflation port of the control means to the inlet of the packer set chamber, and thus, such fluid will inflate the packer.

As mentioned, the first position is not only an inflation position but also a deflation position. When it is desired to deflate the packer, the closable zone of the control means is left open. Thus, fluid from the packer set chamber can flow through the inflation port to the interior of the annular control means, out through its lower end to the interior of the packer foundation, and thence through the bypass passageway to the annulus between the tool and the well bore wall.

In the second or set position of the apparatus, the seal means is operative to seal the inflation port of the control means from communication with either the chamber inlet or the bypass passageway of the upper packer head, to seal the chamber inlet with respect to the control means so as to prevent egress of fluid from the packer set chamber, and to seal the bypass area of the control means from communication with the bypass passageway of the upper packer head. Thus, in the set postion, with both the bypass passageway and the packer set chamber effectively sealed off from communication with the interior of the tool, said tool interior may be used to perform various functions with respect to the well and requiring the direction of fluids through the interior of the tool.

In at least some preferred embodiments of the invention, the assembly further includes a second packer tool connected in tandem with the first packer tool by a tubular mandrel extension interconnecting the packer foundations of the two tools and spacing the tools apart. The packer set chambers of the two tools are communicated with each other so that they are inflated and deflated virtually simultaneously via the control means of the first tool.

The use of such tandem packers introduces additional considerations, which are addressed by further aspects of the present invention. In particular, one such consideration is the fact that, as the two packer bodies are simultaneously inflated, there may be a tendency for excessive pressures to develop in the zone of the annulus being isolated between the two packers as fluid is trapped in that zone by the expanding packer bodies. However, the mandrel extension, which will, of necessity, be located in the zone being isolated, has radial port means therethrough. Thus, fluid which might tend to be trapped in that zone can flow into the mandrel extension, which in turn communicates with the central flowway of the first or uppermost packer tool. Thence, the fluid may flow from the central flowway of the upper tool through the bypass passageway into the annulus of the well above the upper packer. Thus, fluid cannot be trapped in the zone isolated between the two packers.

Even so, still another problem can develop, once the packer bodies are fully inflated, as the control means is moved downwardly from its first or inflation-deflation position to its second or set position. As mentioned above, such movement closes the bypass passageway, but it is highly desirable that the control means be moved further downwardly to a full set position to ensure proper positioning of all the seal means. Once the bypass passageway has been closed, the control means, in moving further downwardly, must displace fluid from the interior of the mandrel just below. Ordinarily, the lower end of the mandrel of the lower tool is closed by suitable means so that fluid can be pumped through the aforementioned radial ports in the mandrel extension to the well zone isolated between the two packers. Thus, as the control means is moved downwardly, the fluid in the interior of the assembly cannot be displaced into the lower portion of the well below the lower packer. If the portion of the well between the two inflated packers is cased or otherwise relatively non-porous, such fluid likewise cannot be displaced into that portion of the well, e.g. through the radial ports in the mandrel extension.

To accommodate this situation, the present invention provides, preferably adjacent the lower end of the mandrel of the second or lower packer tool, a cylinder with a piston slidably sealingly disposed therein. Thus, the piston may serve as a desired closure for the lower end of the entire assembly. A compression spring or the like yieldably urges the piston upwardly, i.e. toward the control means. Thus, as the control means is moved downwardly, the piston can be forced downwardly against the biasing force of the spring to accommodate the fluid displaced by the control means. The portion of the cylinder below the lowermost position of the piston has a port therethrough. Thus, fluid displaced by the piston, in turn, can be accommodated by the portion of the well below the lower packer.

As previously mentioned, the lower end of the control means is cooperative with a releasable closure means. This may be a frangible disk pre-mounted in the lower end of the control means, or a plug which is emplaced on a suitable seat in the lower end of the control means. In any event, such closure means, which allows pressure to be applied through the operating string to inflate the packers, is located in the control means, rather than at the bottom of the lowermost mandrel.

In one preferred embodiment of the invention, the assembly further comprises a plug ejector adjoined to the upper packer head. The plug ejector is disposed in the interior of the upper packer head, but adapted to permit flow through the interior of said upper packer head. This plug ejector has a free end extending upwardly and positioned for telescopic movement with respect to the lower end of the control means upon its movement between the first and second positions. Thus, a reseatable plug may be employed on the seat of the control means. In the first position, this plug will be located above the plug ejector and thus effectively close the lower end of the control means so that the packer can be inflated. When the control means is moved downwardly to the second position, at a suitable point after the packer set chamber has been sealed off, the plug ejector will contact the plug and force it upwardly and off of its seat thereby permitting flow through the lower end of the control means. The plug can be released and reseated any number of times, when such is desired, without the need for either retrieving the plug or pumping it out through the lower end of the control means.

Accordingly, it is a principal object of the present invention to provide a multi-set type packer having a bypass system permitting fluid from the packer set chamber to be released, ultimately, into the well annulus.

Another object of the present invention is to provide a unique piston and cylinder arrangement for effectively closing the lower end of a packer assembly while accommodating fluid displacement by a control means located generally thereabove.

Still another object of the present invention is to provide a plug ejector system for allowing multiple releases and reseatings of the same plug downhole within the interior of a packer assembly.

Still other objects, features and advantages of the present invention will be made apparent by the following detailed description, the drawings, and the claims.

BRIEF DESCRIPTION OF THE DRAWINGS

FIG. 2 is an enlarged longitudinal cross-sectional view similar to the upper portion of FIG. 1A, but with the closure plug removed.

FIG. 3 is a detailed view taken on the line 3—3 of FIG. 2 and showing a J-slot.

FIG. 4 is a transverse cross-sectional view taken on the line 4—4 of FIG. 2.

DETAILED DESCRIPTION OF THE PREFERRED EMBODIMENT

Figure 1A:
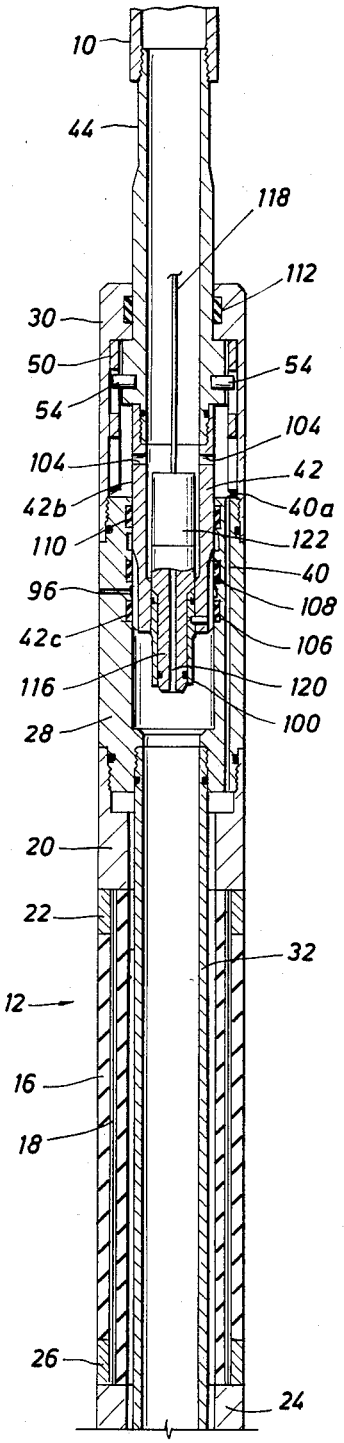
FIGS. 1A, 1B and 1C are, respectively, longitudinal crosssectional views of successively lower portions of a packer assembly according to the present invention in its inflation position.

Referring now to the drawings, FIGS. 1A through 5C depict a first embodiment of packer assembly according to the present invention. Referring more specifically to FIGS. 1A through 4, the assembly is shown in a first position. The assembly is adapted to be run into a well by an operating string of tubing or the like, the lower end of which is shown at 10. Generally, the assembly comprises a first or upper inflatable type packer tool 12 and a second or lower inflatable type packer tool 14, connected in tandem. As used herein, terms such as "upper," "lower," "above" and "below" will be used for convenience to refer to the assembly as shown in the drawings and as typically used, and should not be construed in a limiting sense.

First or upper packer tool 12 comprises a flexible tubular packer body 16, which may be more or less conventional in form. Briefly, packer body 16 includes radially inner and outer elastomeric portions between which are reinforcing cables 18. An upper base ring 20 is connected to the upper end of packer body 16 in a well known manner, e.g. by a suitable clamping arrangement (not shown). Similarly, the lower end of packer body 16 is connected to a lower base ring 24. Support rings 22 and 26 may be positioned about the outer periphery of the packer body 16 adjacent base rings 20 and 24, respectively, also in a manner and for a purpose well known in the art.

Upper base ring 20 has its upper end threadedly connected and sealed with respect to a main sub 28 of the upper packer head of first tool 12. The upper end of sub 28 is threadedly connected and sealed with respect to a connector sub 30, which effectively forms an extension of the upper packer head. Thus, for purposes of the present description, the upper packer head of tool 12 maybe considered as effectively being made up of subs 28 and 30. A tubular mandrel 32 has its upper end threadedly connected and sealed with respect to the lower end of main sub 28 so that it extends downwardly coaxially through upper base ring 20, packer body 16, and lower base ring 24. As used herein, the term "packer foundation" will refer to those parts of the tool which do not move relative to the packer head in use, and specifically includes the packer head itself as well as upper base ring 20 and mandrel 32. By way of contrast, packer body 16 and control sub 42 (described hereinafter) do not form part of the packer foundation.

Figure 1B:
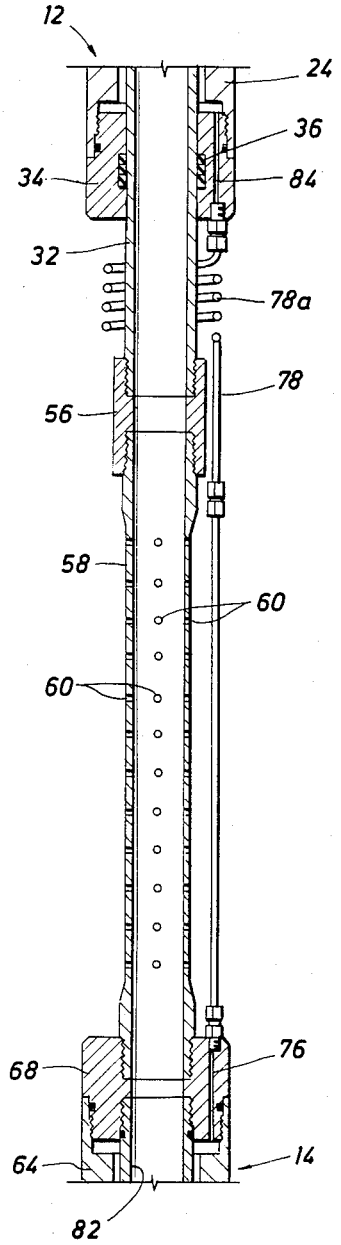

Referring to FIG. 1B, it can be seen that, when packer body 16 is in its deflated condition, mandrel 32 extends downwardly below lower base ring 24 by a substantial distance. Lower base ring 24 is threadedly connected and sealed with respect to an annular lower packer head 34. This lower packer head 34 coaxially surrounds the lower portion of mandrel 32, which extends downwardly therethrough. The inner diameter of sub 34 is sized for a sliding fit on the outer diameter of mandrel 32, and is sealed with respect to mandrel 32 by annular seal 36.

It can be seen that an annular packer set chamber is formed in the area between mandrel 32 and packer body 16. The lower end of this chamber is sealed off by seal 36. The upper end of the space between packer body 16 and mandrel 32 is continuous with a similar space between mandrel 32 and upper base ring 20, which in turn communicates with a longitudinal bore 40 extending through main sub 28 of the upper packer head, all of these void areas forming parts of the packer set chamber. The internal dimensions of connector sub 30 of the upper packer head are such that the axially facing end surface of sub 28 is generally exposed therein. The upper end **40*a* of bore 40** opens through such exposed end face and serves as a chamber inlet for the packer set chamber, in a manner to be described more fully below.

It can be seen that, as fluid pressure is introduced to the packer set chamber through inlet **40*a*, packer body 16 may be inflated or radially extended so that it may sealingly contact a surrounding well bore wall. Such radial extension causes foreshortening of the packer body 16, which is permitted by lower packer head 34 sliding upwardly on mandrel 32**.

As shown in FIGS. 1A and 2, tool 12 further comprises an annular flow control sub 42 mounted coaxially within upper packer head 30,28 for telescopic movement, i.e. relative longitudinal reciprocation, with respect thereto. A connector sleeve 44 is threadedly connected to the upper end of control sub 42 and effectively forms a part of the control means. Its upper end in turn is threadedly connected to the operating string 10. As shown, the lower portion of sleeve 44 is disposed within connector sub 30 of the upper packer head, and sleeve 44 and sub 30 have opposed axially facing shoulders 46 and 48 respectively whereby the tool 12 may be supported on the sleeve 44, and thus on the operating string 10. Sleeve 44 also has a downwardly facing shoulder 49 for a purpose to be described hereafter.

A slotted sleeve 50 is affixed to the interior of, and forms a part of, connector sub 30 of the upper packer head. Sleeve 50 has a pair of diametrically opposed J-slots 52 cut therethrough. Once sleeve 50 is emplaced within connector sub 30, the latter closes the radially outer sides of slots 52. Connecting sleeve 44 carries a pair of lugs 54 which extend radially outwardly into respective slots 52 to interconnect sleeve 44 and the attached control sub 42 with the upper packer head 30, 28 and to perform an indexing function, described more fully below.

As previously mentioned, and as shown in FIG. 1B, the lower end of mandrel 32 extends downwardly through lower packer head 24, 34, even when packer body 16 is deflated, and thus maximally elongated. This protruding lower end of mandrel 32 is connected by a double box sub 56 to a tubular mandrel extension 58 which interconnects and spaces apart the two tools 12 and 14. Mandrel extension 58 has a plurality of radial ports 60 therethrough, for a purpose to be described more fully below.

Figure 1C:
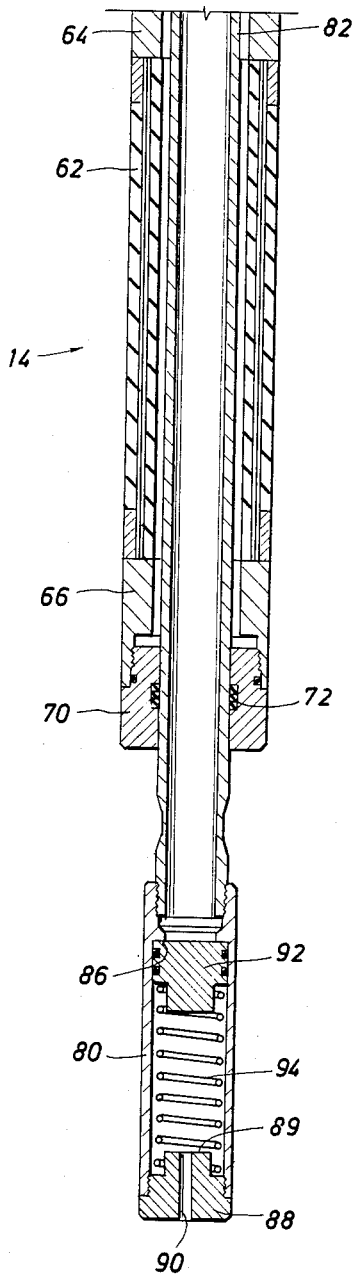

As shown in FIGS. 1B and 1C, the second or lower packer tool 14 includes a flexible tubular packer body 62 of the inflatable type which, being substantially identical to packer body 16, will not be further described in detail. The upper end of packer body 62 is connected to an upper base ring 64, analogous to upper base ring 20 of the first tool, while the lower end of packer body 62 is coaxially connected to a lower base ring 66, analogous to lower head base 24 of the first tool. Lower base ring 66 is threadedly connected and sealed with respect to a lower packer head 70. Upper base ring 64 is threadedly connected and sealed with respect to an upper packer head 68 of the second tool 14.

The second tool further includes a mandrel 82 which is threadedly connected and sealed with respect to the lower end of head 68 and extends coaxially downwardly through upper base ring 64 and packer body 62 and thence through the lower base ring 66 and lower packer head 70. Head 70 is sized to slidably engage mandrel 82, and is sealed with respect to mandrel 82 by annular seal 72. Thus, seal 72 seals off the lower end of a packer set chamber of tool 14, which chamber includes the space between mandrel 82, on the one hand, and packer body 62 and the attached base rings 64 and 66, on the other. The packer set chamber of tool 14 further includes a longitudinal bore 76 extending through upper packer head 68. It may be noted that bore 76 opens through the lower end face of head 68, which is generally exposed within the interior of base ring 64.

The packer set chambers of the tools 12 and 14 are communicatively connected, independently of mandrel extension 58, by a spanner conduit in the form of tube 78 which runs generally along the outside of mandrel extension 58 and the lower portion of mandrel 32. More specifically, tube 78 has its upper end connected by a suitable fitting to lower packer head 34 of first tool 12 in position for communication with a longitudinal bore 84 which extends through head 34 and opens through its exposed upper end face, as shown in FIG. 1B. Near its upper end, tube 78 has a coiled or spiral portion **78*a* wound about mandrel 32. Section 78 can expand to accommodate the upward movement of lower packer head 34 of tool 12 when the respective packer body 16 is inflated. The lower end of tube 78 is connected by a suitable fitting to bore 76. Thus, when the packer body 16 of the upper tool 12 is inflated, the packer body 62 of the lower tool 14 will also be automatically inflated. Likewise, when the upper packer body 16 is deflated, the lower packer body 62** will also be deflated.

As shown in FIG. 1C, when packer body 62 is in its deflated, and thus elongated, configuration, the lower end of mandrel 82 still extends downwardly through the lower packer head 70. A cylinder 80 is threadedly connected to the lower end of mandrel 82 and forms an extension thereof. Cylinder 80 has an internal upper annular stop shoulder 86 integrally formed therein. A stop member 88 having a central longitudinal bore 90, is threadedly connected to the lower end of cylinder 80 to form a stepped annular lower stop shoulder 89 opposing shoulder 86. A piston 92 is disposed within cylinder 80 for longitudinal reciprocation, and is sealed with respect to cylinder 80. A helical compression spring 94 interposed between piston 92 and stop member 88 yieldably urges piston 92 upwardly, i.e. toward control sub 42, with such upward movment of piston 92 being limited by its abutment with upper annular stop shoulder 86.

FIGS. 1A through 1C show the assembly in what will be referred to herein as the first or "inflation-deflation" position, which position is likewise assumed during running in and retrieval of the tool. In this first position, and as shown in FIGS. 1A, 2 and 3, each lug 54 is disposed adjacent the upper end **52*g* of an upper vertical run 52*f* of its respective J-slot 52**.

As previously mentioned, the main sub 28 of the upper packer head of first tool 12 defines an inlet **40*a* for the packer set chamber. In addition, sub 28 has a radial bypass passageway 96 extending therethrough. Passageway 96 is in fact a straight radial bore. However, any such passageway will be considered "generally radially extending" for purposes of the present invention if it permits communication of the interior of the upper packer head with the exterior of the upper packer head. Passageway 96 has its radially inner opening 96*a* positioned in communication with an internal annular bypass groove 98 in sub 28. The radially inner opening 96*a* of bypass passageway 96 is disposed below chamber inlet 40*a*. Bypass passageway 96 is circumferentially spaced from, and does not intersect, bore 40. Therefore, bypass passageway 96** is isolated from direct communication with the packer set chamber.

The control sub 42, as mentioned, is annular. Thus, its lower end—and more specifically the central longitudinal bore **42*a* therethrough—allows for flow of fluid downwardly through the control sub 42 into the interior of the head 28. However, the lower end of control sub 42 has a closable zone adapted for cooperation with releasable closure means for selectively blocking such flow. More specifically, when initially run into the well, the lower end of sub 42 is dressed with an annular seat 100 connected to the lower end of sub 42 by a shear pin 102 and sealed with respect to sub 42. The upper end of seat 100 defines a shoulder on which a suitable plug may rest. Well above seat 100, sub 42 is provided with radial inflation ports 104**.

A number of annular seal means, in the form of elastomeric seal rings, are provided for sealing between the upper packer head 30, 28, 20 and the control means 42. In the embodiment shown, all such seal rings are carried in internal annular grooves in subs 30 and 28 of the upper packer head. However, in alternative embodiments, at least some of these seals might be carried in external annular grooves in control sub 42. Furthermore, in the embodiment shown, each seal means comprises an elongate seal ring. In alternative embodiments, each seal means could include a closely adjacent pair or trio of individual seal rings. In any event, these seals control communication through and between the various openings in subs 28 and 42, and the patterns of such communication are altered depending upon the relative positions of control sub 42 with respect to sub 28.

More specifically, the seal means include: lower bypass seal ring 106 disposed below radially inner opening 96a of bypass passageway 96; a primary upper bypass seal ring 110 disposed well above opening 96*a* and between that opening and the chamber inlet 40*a;* an auxiliary upper bypass seal ring 108 disposed above opening 96*a* and between that opening and the primary upper bypass seal ring 110; and an upper inflation seal ring 112 disposed near the upper end of sub 30 well above chamber inlet 40*a*. (It is noted that seal ring 112 will always be disposed above inflations ports 104 regardless of the position of control sub 42).

Control sub 42 has a cylindrical seal section 42*b* on its external periphery above its lower end, and more specifically, extending above and below inflation ports 104. The diameter of seal area 42*b* is such as to be sealingly engaged by any of the seal rings 106, 108 or 110, when aligned therewith. Below seal section 42*b*, and extending along its lower end, sub 42 has a bypass section 42*c* on its outer periphery. For reasons to be explained more fully below, the lower portion 42*a* of the central longitudinal bore of sub 42, and bypass section 42*c* jointly form the bypass area of sub 42.

Bypass section 42*c* has a reduced outer peripheral profile, as compared with seal section 42*b* so that it will not be sealed by any of the seal rings 106, 108, or 110, even if aligned therewith. Such a reduced outer peripheral profile could be provided by simply forming the bypass section with a smaller outer diameter. However, to eliminate abrupt external shoulders on sub 42, which might damage the seal rings when passing longitudinally thereby, the maximum outer diameter of bypass area 42*c* is left equal to the outer diameter of seal area 42*b*, and the outer peripheral profile is reduced by providing longitudinal slots 114 along bypass area 42*c* opening both radially outwardly and longitudinally downwardly.

Referring to FIGS. 1A and 2, it can be seen that, when the tool is in the first position, seal ring 112 is sealingly engaged against connector sleeve 44 above inflation ports 104 and chamber inlet 40*a*. Seal ring 110 is sealingly engaged against seal area 42*b* of sub 42 below inflation ports 104. Therefore, in this position, communication between ports 104 and chamber inlet 40*a* is permitted, and a seal is formed at 110 between chamber inlet 40*a* and radially inner opening 96*a* of bypass passageway 96. In addition, bypass area 42*c* is aligned with lower bypass seal ring 106, whereby the latter is "released" or rendered ineffective. Thus, there is at least the potential (with no plug on seat 100, as in FIG. 2) for fluid flow downwardly through the lower end 42*a* of the central bore of sub 42, up through slots 114, through groove 98 to bypass passageway 96, and thence out to the exterior of the tool.

From this starting point, i.e. with the tool in its first position, an exemplary operation is as follows:

As shown in FIG. 1A, a dart-type plug 116 is lowered on a line 118 through the operating string 10, the connector sleeve 44, and the sub 42, until its seats on the upper end of seat 100. Plug 116 has a longitudinal bore 120 opening through its lower end, but the upper end of bore 120 is effectively closed by a transducer 122 connected to the top of plug 116. This closes the lower end 42*a* of the central bore of sub 42.

Fluid pressure is then applied through operating string 10. Due to the engagement of seal ring 112, such pressurized fluid cannot flow outwardly from the tool, and due to the engagement of seal ring 110, and the presence of plug 116, such fluid cannot flow to the bypass passageway 96, nor down into mandrel 32. However, because, in the inflation position, the seal means are arranged to permit communication between inflation ports 104 and chamber inlet 40*a*, such pressurized fluid will flow into the chamber inlet, thence into the packer set chamber, of packer body 16, thereby inflating and radially extending that packer body. As previously mentioned, lower packer head 34 of tool 12 will slide upwardly on mandrel 32 to accommodate such radial extension, and this longitudinal movement in turn will be accommodated by a spreading or stretching of spiral section 78*a* of tube 78. Furthermore, tube 78 will permit the pressurized fluid to flow into the packer set chamber of lower tool 114, similarly inflating packer body 62.

As mentioned above, the lower end 42*a* of the central bore of sub 42 forms a part of the bypass area of sub 42 and thus a part of the overall bypass system of the packer assembly, and this portion of the bypass system has been closed by plug 116. However, bypass slots 114 continue to provide communication of the bypass passageway 96 with the interior of the packer foundation of the first tool below sub 42. Thus, as the packer bodies 16 and 62 are inflated, and if the area therebetween is cased, as shown at 124, or otherwise impermeable, the pressure of any fluid which might otherwise be trapped between the two packer bodies may be relieved. Such fluid may flow through ports 60 into mandrel extension 58, upwardly through mandrel 32, through slots 114, groove 98, and bypass passageway 96, to the exterior of the assembly above the upper packer body 16.

When the packer bodies 16 and 62 are fully inflated and sealingly engaged with the well bore wall, in this case casing 124, the assembly may be "set" or locked into its inflated condition by moving control sub 42 to its second or set position. This is accomplished by "slacking off" the operating string 10, i.e. decreasing the upward pull on the string so as to allow it weight to carry it downwardly, while applying a clockwise rotational force. It is noted that such downward movement of operating string 10 and the connected sub 42 will be possible without corresponding downward movement of the packer head 30, 28 previously supported thereby, since that packer head is now supported within the well by virtue of the engagement of packer body 16 with casing 124.

Such movement will cause each lug 54 to move from the upper vertical run 52*f* of its respective J-slot 52 through an upper angular run 52*a* of the J-slot. This will bring the lug 54 into a central vertical run 52*b*. This prevents further clockwise rotation. The operator will continue to leave slack on the operating string 10 and the resilience of the operating string will allow the lug to move counterclockwise through a lower angular run 52*c* of its J-slot and into a lower vertical run 52*d*. Downward movement is finally stopped by abutment of shoulder 49 with the top of sub 28. At this point, releasing the clockwise force allows the operator to pull up on the operating string 10 so as to bring lug 54 into engagement with an upper stop 52*e* in run 52*d* to ensure that the sub 42 has reached its proper set position, as shown in FIG. 5A.

Figure 5A:
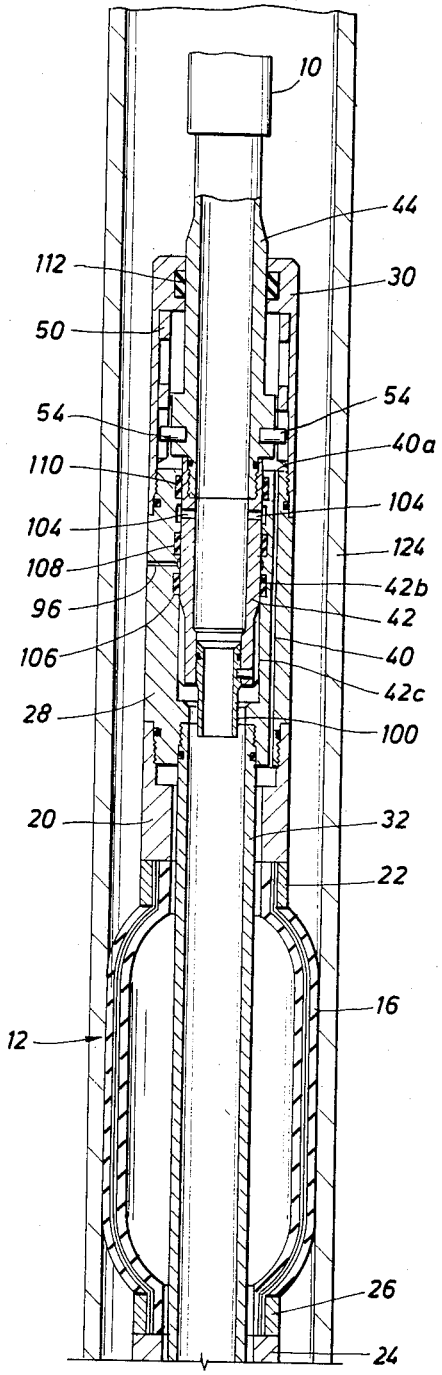
FIGS. 5A–5C are, respectively, longitudinal cross-sectional views through successively lower portions of the packer assembly of FIGS. 1A–1C, but showing the parts in the set position.
Figure 5B:
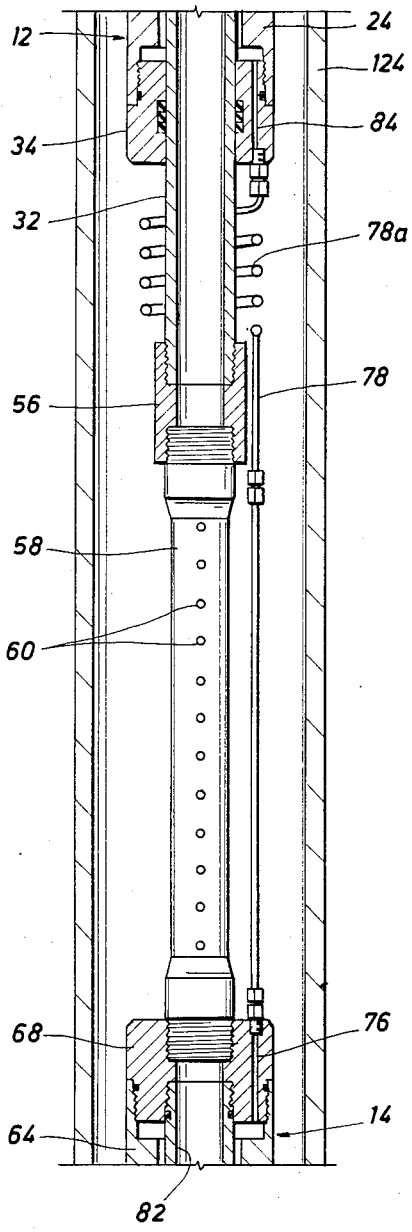
Figure 5C:
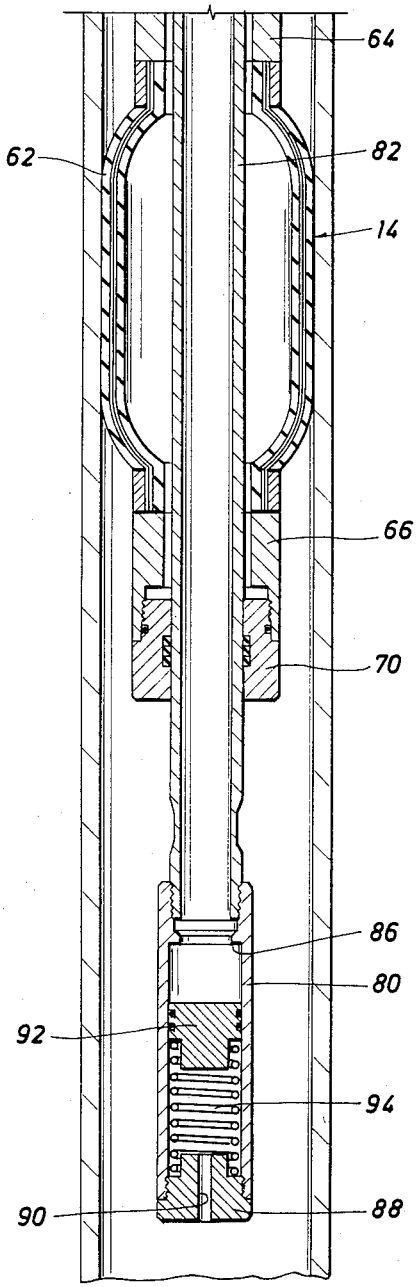

With the tool in set position, as shown in FIGS. 5A through 5C, sub 42 will have been moved downwardly with respect to upper packer head 30, 28 of first tool 12. Seal ring 112 will still be engaged with connector sleeve 44, while seal area 42*b* of sub 42 will be engaged with all three of the seal rings 106, 108 and 110, with inflation ports 104 located between seal rings 108 and 110.

Thus, chamber inlet 40*a* is isolated from communication with the central flowway of the tool or the exterior of the tool by seals 112 and 110, and egress from the packer set chamber is prevented. Inflation ports 104 are isolated from communication with either the chamber inlet or the bypass passageway 96 by seals 110 and 108. Bypass passageway 96 has been effectively closed to communication with the interior of the tool by seal rings 108 and 106. More specifically, seal rings 106, with slots 114 having been relatively displaced therefrom, are activated or engaged with seal section 42*b*, and this effectively prevents any communication between lower end 42*a* of the central bore of sub 42 and bypass passageway 96.

Accordingly, plug 116 can be lifted from its seat by line 118, or replaced, as desired, to perform various operations within the well. For example, if plug 116 is retrieved, fluid may be pumped downwardly through operating string 10 and sub 42 and communicated with the space between the inflated packer bodies 16 and 62 via ports 60. Conversely, fluid from the space between the inflated packer body may pass upwardly to the top of the well. With plug 116 in place (or replaced after having been unseated) the pressure in the space between the inflated packer bodies may be communicated through bore 120 to transducer 122, which blocks such pressure from being relieved into the operating string, but produces an electric signal which is a function of the pressure and communicates that signal to the operator through line 118.

During all these operations, the mandrel 32, the mandrel extension 58, and the mandrel 82 are closed from communication with the portion of the well below packer body 62 by piston 92. This route of communication was already closed when the sub 42 was moved from its inflation position to its set position. Furthermore, during such movement, once sub 42 moved downward sufficiently to bring seal area 42*b* into alignment with seal ring 106, the interior of the mandrels and mandrel extension were blocked from communication with the portion of the well above upper packer 16. Nevertheless, sub 42 has to move downwardly still further in order to reach a fully set position. To do so, sub 42 has to displace fluid from within mandrel 32 and those parts communicating therewith below sub 42. If the well is lined with a casing such as shown at 124, or is otherwise non-porous in the zone between the two inflated packer bodies 16 and 62, such downward movement of sub 42 is permitted by virtue of the fact that piston 92 can move downwardly against the bias of spring 94 to accommodate the fluid thus displaced. The movement of piston 92 is in turn accommodated by virtue of the fact that bore 90 in the lower end of cylinder 80 communicates with the lowermost zone of the well, below packer body 62 and casing 124.

When it is desired to release the tools from their set condition, plug 116, if present, is retrieved by line 118, and the tool is returned to its inflation position by a reverse operation of the operating string bringing each lug 54 once again into the uppermost vertical run 52*f* of its respective J-slot. Positive location of the inflation position can be determined by working the operating string up and down to "feel" the upper and lower stops 52*g* and 52*h* of upper vertical run 52*f*.

As best shown in FIG. 2, with chamber inlet 40*a* once again communicating with inflation ports 104, fluid from the packer set chamber can flow through chamber inlet 40*a* and ports 104 into the interior of sub 42. With plug 116 having been removed, the fluid can then flow downwardly through the lower end 42*a* of the central bore of sub 42. Thence, fluid can, if necessary, flow upwardly through slots 114, around groove 98, and out through bypass passageway 96 into the annulus of the well. Thus, even through the fluid from the packer set chambers is initially directed into the interior of the tool, it may ultimately find its way through the bypass system to the annulus, so that the tool may be released even if, for example, the operating string 10 stands essentially full of liquid, but the annulus does not.

The assembly can then be moved, as desired, in the well by means of the operating string 10. When it is desired to reinflate an reset, a plug is again passed downwardly through the operating string 10 until it seats on seat 100. Then, the operation may be repeated as described hereinabove.

It is particularly noted that the pins 54 and slots 52 are provided simply as a convenient indexing means, but are not absolutely essential for proper operation. More specifically, it is noted that the various operative positions of the control means can be achieved through straight longitudinal movement without the need for any rotation of the operating string, and thus, without the need for the slots and lugs.

Many variations in the form of releasable closure means, for blocking the lower end 42*a* of the central bore of sub 42 during inflation, are possible. For example, instead of a retrievable type plug run in on a line 118, the plug may be of a form which is simply pumped downwardly freely through the operating string. It may be either compressible or incompressible, and may take various forms, such as dart form, ball form, etc. If such a free plug is of the compressible type, e.g. a plastic ball which will gradually deteriorate under the conditions present downhole, then when it is desired to open the lower end of sub 42, such plug may simply be pumped downwardly through seat 100 by applying appropriate fluid pressure through operating string 10. On the other hand, if the plug is incompressible, e.g. a metal ball, fluid pressure may nevertheless be applied through the operating string 10 to sever the shear pin 102 and allow both the seat 100 and the ball to be pumped downwardly. It is noted that, even after seat 100 has been released from sub 42, the tool may be reset by emplacing a larger size plug on a shoulder 126 in the lower end of sub 42 above the locus of seat 100. In such case, if it is desired to subsequently reopen sub 42, then the plug must be of the compressible type or must be retrievable by means of a line such as 118. In still other variations, the lower end of sub 42 may be initially dressed not with an annular seat such as 100, but rather with a closure member, such as a frangible disk. When it is desired to open the lower end of sub 42, such a disk can be sheared out or broken, in a manner well known in the art.

Figure 6:
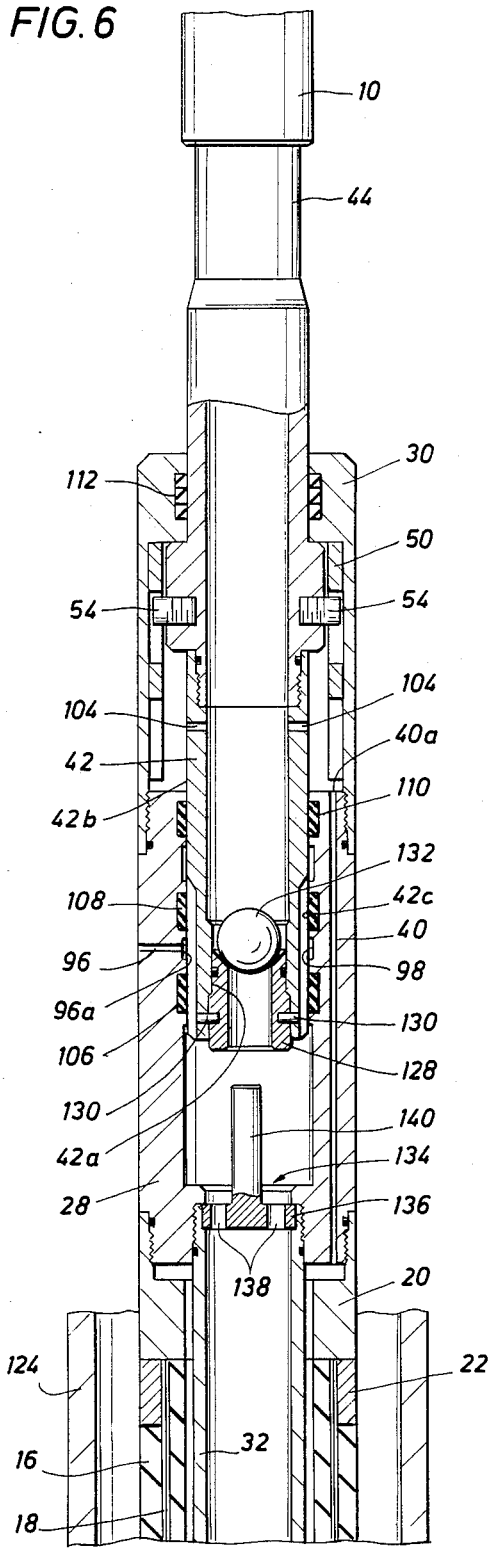
FIG. 6 is a longitudinal cross-sectional view through the upper portion of another embodiment of the present invention showing a plug ejector, and showing the parts in the inflation position.
Figure 7:
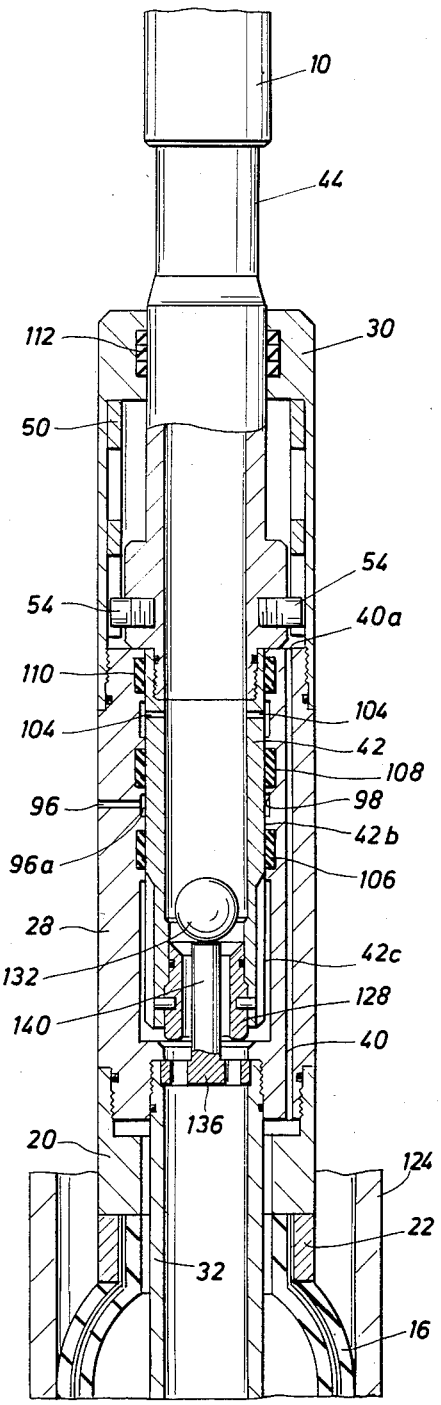
FIG. 7 is a view similar to that of FIG. 4 showing the apparatus in the set position.

FIGS. 6 and 7 show another embodiment of the invention which allows multiple openings and closings of the lower end of the control sub downhole using an incompressible and nonretrievable type plug. Most parts of the tool are identical to analogous parts of the first embodiment described hereinabove. Such parts have been given like reference numerals, and will not be further described in detail.

Referring now particularly to FIG. 6, it will be seen that the lower end of sub 42 has been dressed with a modified form of seat 128. Seat 128 is connected to sub 42 by shear pins 130, and is adapted to receive an incompressible-type plug such as metal ball 132. A plug ejector generally designated by the numeral 134 has been fixedly mounted within the interior of main sub 28 of the upper packer head so that it is disposed in the interior thereof but adapted to permit flow through the interior of said upper packer head.

More specifically, plug ejector 134 includes a base 136 which is fixedly attached coaxially within the upper end of mandrel 32, which in turn is disposed within sub 28. Ports 138 through base 136 prevent base 136 from obstructing the interior of the packer head from the necessary fluid flow. The plug ejector further comprises an elongate prong 140 having a free end extending upwardly from base 136. Prong 140 is much smaller in outer diameter than the inner diameter of the surrounding portion of the upper packer head, again to avoid undue obstruction of fluid flow.

The free upper end of prong 140 is positioned for telescopic movement with respect to the lower end of sub 42 and the seat 128 carried thereby. The length and position of prong 140 are pre-selected so that, when sub 42 is moved to its set position, as shown in FIG. 7, prong 140 will move past the upper end of seat 128 and lift ball 132 thereform. This permits fluid flow past seat 128 so that any desired operations may be performed on the well zone between the two inflated packer bodies. Note that the outer diameter of prong 140 is smaller than the inner diameter of seat 128, so as not to interfere with such fluid communication. If it is desired to reseat ball 132, sub 42 is simply returned to its inflation position, as shown in FIG. 6.

Whenever it is desird to deflate and retrieve the tool, the tool must be placed in its inflation position, but without ball 132 effectively closing the lower end of sub 42. To accomplish this, the apparatus is first returned to the position of FIG. 6, then fluid pressure is applied through the operating string 10 to sever shear pins 130. Seat 128 will fall down over prong 140, but due to the difference in diameters referred to above, will not obstruct flow. Meanwhile, ball 132 will no longer have a sufficiently small seating surface to allow it to block the lower end 42*a* of the central bore of sub 42. If the tool interior is provided with more than enough space to accommodate seat 128 and ball 132, the tool can be reinflated and reset downhole by installing a new plug on shoulder 126. When it is once again desired to release the tool, this second ball can then simply be pumped into the aforementioned ample space already accommodating seat 128 and ball 132.

The foregoing represent preferred embodiments of the invention, but it will be understood that numerous modifications are possible within the spirit of the invention and the skill of the art. Some such modifications have been indicated in the foregoing specification. It is also noted that, while the present invention has been described in the context of an assembly including a pair of inflatable packer tools connected in tandem, at least some aspects of the invention can likewise be applied to other types of packers and/or to assemblies including only a single packer or more than two packers. Accordingly, it is intended that the scope of the present invention be limited only by the claims which follow.

What is claimed is:

1. A downhole packer assembly, including a first packer tool, defining a central longitudinal flowway and comprising:

a flexible tubular packer body disposed generally coaxial to said central flowway and radially extendable and retractable for contact with and release from a well bore wall;

means defining a packer set chamber in pressure communicating relation with said packer body whereby said packer body may be radially extended by fluid pressure in said packer set chamber;

a generally annular packer foundation coaxially connected to the upper end of said packer body;

means defining a bypass flow system for permitting flow of fluid from said packer set chamber to said central flowway and from said central flowway radially outwardly through said packer foundation to the exterior of said assembly;

and control means adjacent said packer foundation and movable with respect to said packer foundation between a first position, for opening said bypass system, and a second position, for closing said bypass system.

2. The assembly of claim 1 wherein said control means is further operative, in said first position, to permit communication between said central flowway and said packer set chamber, and in said second position, to close said packer set chamber.

3. The assembly of claim 2 wherein:

said packer foundation comprises an annular upper packer head connected to the upper end of said packer body, said upper packer head defining a chamber inlet for said packer set chamber, an said upper packer head further having a bypass passageway extending generally radially therethrough, said bypass passageway being isolated from direct communication with said packer set chamber and having a radially inner opening longitudinally spaced from said chamber inlet;

said control means is generally annular and is disposed at least partially telescopically within said upper packer head for relative longitudinal movement between said first and second positions, said control means having an internal closable zone adapted for cooperation with releasable closure means, an inflation port spaced above said closable zone and extending generally radially therethrough, and a bypass area;

said packer assembly further comprising seal means cooperative between said upper packer head and said control means and operative in said first position to seal between said upper packer head and said control means between said chamber inlet and said radially inner opening of said bypass passageway, permit fluid communication between said inflation port and said chamber inlet, and permit fluid communication between said bypass area of said control means and said radially inner opening of said bypass passageway;

and in said second position to seal said inflation port of said control means from communication with either said chamber inlet or said bypass passageway, seal said bypass area of said control means from communication with said bypass passageway, and seal said chamber inlet with respect to said control means so as to prevent egress of fluid from said packer set chamber.

4. The assembly of claim 3 wherein:

said closable zone is located generally in the lower end of said control means;

said bypass area comprises the lower end of the central bore of said control means;

said chamber inlet is disposed above said radially inner opening of said bypass passageway;

and said first and second positions are upper and lower positions, respectively, and said control means.

5. The assembly of claim 4 wherein said seal means comprises:

annular upper bypass seal means sealingly engaged between said control means and said packer head intermediate said chamber inlet and said radially inner opening of said bypass passageway in both said first and second positions, and annular lower bypass seal means sealingly engaged between said control means and said packer head below said radially inner opening of said bypass passageway in said second position, and released from such sealing engagement in said first position.

6. The assembly of claim 5 wherein said lower bypass seal means is carried on the interior of said upper packer head below said radially inner opening of said bypass passageway, and said upper bypass seal means is carried on the interior of said upper packer head above said radially inner opening of said bypass passageway and below said chamber inlet;

and wherein said control means has a seal section on its outer periphery between said inflation port and the lower end of said control means, which seal section, in said first position, is disposed adjacent and sealingly engaged with said upper bypass seal means, and in said second position, is disposed adjacent and sealingly engaged with said lower bypass seal means, and said bypass area further comprises a bypass section on the outer periphery of said control means below said seal section, said bypass section having a reduced outer peripheral profile, as compared with said seal section, and which bypass section, in said first position, is aligned with said lower bypass seal means to permit communication between said lower end of the central bore of said control means and said bypass passageway, and in said second position, is disposed below said lower bypass seal means.

7. The assembly of claim 6 wherein said bypass section has a maximum outer diameter equal to the outer diameter of said seal area and longitudinal slot means extending therealong;

and wherein said upper packer head has an annular internal bypass groove intersecting said radially inner opening of said bypass passageway.

8. The assembly of claim 7 wherein said upper bypass seal means comprises a primary upper bypass seal spaced above said radially inner opening of said bypass passageway and which is so sealingly engaged in at least said first position, and an auxiliary upper bypass seal disposed between said primary upper bypass seal and said radially inner opening of said bypass passageway and which is so sealingly engaged in at least said second position.

9. The assembly of claim 8 wherein, in said second position, both said upper bypass seals are so sealingly engaged and are disposed respectively on opposite sides of said inflation port.

10. The assembly of claim 9 wherein said seal means further comprises annular upper inflation seal means sealingly engaged between said control means and said upper packer head above said inflation port and said chamber inlet in both said first and second positions.

11. The assembly of claim 1 wherein said first packer tool further comprises an annular plug seat member releasably secured coaxially within said lower end of said control means and sealed with respect thereto.

12. The assembly of claim 11 wherein said control means has an internal annular seating shoulder above the locus of said plug seat member.

13. The assembly of claim 1 wherein said control means and said upper packer head are interconnected by indexing means for limited relative longitudinal and rotative movement, said indexing means having stop surfaces for indicating said first and second positions.

14. The assembly of claim 3 wherein said packer body is of the inflatable type, said packer foundation further comprising a tubular mandrel adjoined to said upper packer head and extending coaxially through said packer body, and said first packer tool further comprising an annular lower packer head connected to the lower end of said packer body and slidably coaxially surrounding said mandrel and sealed with respect thereto, said packer set chamber comprising an annular space between said mandrel and said packer body.

15. The assembly of claim 14 wherein said packer set chamber further comprises a longitudinal bore extending through said upper packer head from said chamber inlet and circumferentially spaced from said bypass passageway.

16. The assembly of claim 14 further comprising a tubular mandrel extension coaxially adjoining said mandrel and extending downwardly therefrom, and a second inflatable packer tool connected to said mandrel extension distal said first packer tool and having a respective packer set chamber.

17. The assembly of claim 16 wherein said mandrel extension has radial port means extending therethrough.

18. The assembly of claim 17 further comprising spanner conduit means communicatively connecting the packer set chambers of said two packer tools independently of said mandrel extension.

19. The assembly of claim 18 wherein said spanner conduit means comprises a tube extending along the exterior of said mandrel extension and having an expandable section spirally wound about said mandrel and/or said mandrel extension.

20. The assembly of claim 17 comprising:

cylinder means communicatively connected to said upper packer head generally below said control means and having a cylinder port therethrough;

a piston reciprocably disposed in said cylinder and sealed with respect thereto between said control means and said cylinder port;

and means yieldably urging said piston toward said control means.

21. The assembly of claim 20 wherein said second packer tool has a tubular mandrel coaxially adjoining said mandrel extension and defining said cylinder means.

22. The assembly of claim 21 wherein said cylinder has opposed longitudinally facing stop shoulders at its opposite ends, and wherein said means yieldably urging said piston comprises a compression spring cooperative between said piston and the lower of said stop shoulders.

23. The assembly of claim 21 wherein said cylinder is located generally adjacent the lower end of said mandrel of said second packer tool.

24. The assembly of claim 17 wherein said first packer tool further comprises a plug ejector adjoined to said upper packer head and disposed in the interior of said upper packer head, adapted to permit flow through the interior of said upper packer head, and having a free end extending upwardly and positioned for telescopic movement with respect to the lower end of said control means upon movement between said first and second positions.

25. The assembly of claim 16 further comprising a spanner conduit in the form of a tube extending along the exterior of said mandrel extension and having an expandable section spirally wound about said mandrel and/or said mandrel extension, and communicatively interconnecting said packer set chambers of said two packer tools.

26. The assembly of claim 16 wherein said first packer tool further comprises a plug ejector adjoined to said upper packer head and disposed in the interior of said upper packer head, adapted to permit flow through the interior of said upper packer head, and having a free end extending upwardly and positioned for telescopic movement with respect to the lower end of said control means upon movement between said first and second positions.

27. The assembly of claim 3 wherein said first packer tool further comprises a plug ejector adjoined to said upper packer head and disposed in the interior of said upper packer head, adapted to permit flow through the interior of said upper packer head, and having a free end extending upwardly and positioned for telescopic movement with respect to the lower end of said control means upon movement between said first and second positions.

28. A downhole packer assembly including;

a first packer tool comprising a flexible tubular packer body radially extendable for contact with a well bore wall and retractable for release from such well bore wall, a generally annular packer foundation coaxially connected to the upper end of said packer body, and control means mounted within said packer foundation for relative longitudinal reciprocation for controlling the operational mode of said packer body;

a second packer tool disposed below said first packer tool and comprising a flexible tubular packer body radially extendable for contact with a well bore wall and retractable for release from such well bore wall, and a generally annular packer foundation coaxially connected to the upper end of said packer body;

a tubular mandrel extension coaxially connecting the packer foundations of said two tools and longitudinally spacing said two tools apart;

cylinder means communicatively connected to said packer foundations and having a cylinder port therethrough;

a piston reciprocably disposed in said cylinder means and sealed with respect thereto between said control means and said cylinder port; and and means yieldably urging said piston toward said control means.

29. The assembly of claim 28 wherein:

said packer tools are of the inflatable type, each of said tools comprising means defining a packer set chamber in pressure communicating relation to the respective packer body whereby said packer body may be radially extended by fluid pressure in said packer set chamber;

said assembly further comprises means communicatively connecting said two packer set chambers;

each of said packer foundations comprises an upper packer head defining a chamber inlet for the respective packer set chamber;

said control means is generally annular, and in a first position, the interior of said control means is communicatively connected with said chamber inlet;

and said assembly further comprises seal means engageable between said control means and the packer foundation of said first tool and operative, when said control means is in a second position, to seal the interior of said control means from communication with said chamber inlet of said first tool.

30. The assembly of claim 29 wherein said upper packer head further defines a bypass passageway extending generally radially therethrough;

and wherein, when said control means is in said second position, said seal means is further operative to block said bypass passageway.

31. The assembly of claim 30 wherein said control means is adapted for cooperation with releasable closure means for blocking flow through the lower end of the central bore of said control means; and wherein said lower end of said central bore of said control means, in said first position, is disposed—relative to said seal means—for communication with said bypass passageway.

32. The assembly of claim 30 wherein said bypass passageway forms a part of a system providing for communication of the area on the exterior of said assembly between said packer bodies with the area on the exterior of said assembly above the packer body of said first tool.

33. The assembly of claim 30 wherein:

said packer foundation of said first packer tool further comprises a mandrel coaxially connected to said upper packer head and extending downwardly through the respective packer body;

said first packer tool further comprises a lower packer head connected to the lower end of said packer body and slidably coaxially surrounding said mandrel and sealed with respect thereto;

said mandrel extension is coaxially connected to the lower end of said mandrel of said first packer tool and said upper packer head of said second packer tool;

said packer foundation of said second packer tool comprises a mandrel connected to said upper packer head and extending downwardly through the respective packer body;

and said second packer tool further comprises a lower packer head connected to the lower end of the respective packer body and slidably coaxially surrounding the respective mandrel and sealed with respect thereto.

34. The assembly of claim 33 wherein said cylinder means is positioned in coaxial alignment with said packer tools.

35. The assembly of claim 34 wherein said cylinder means is disposed generally adjacent the lower end of the mandrel of said second packer tool.

36. The assembly of claim 34 wherein said cylinder means has opposed longitudinally facing stop shoulders at its opposite ends, and wherein said means yieldably urging said piston comprises a compression spring cooperative between said piston and the lower of said stop shoulders.

37. An inflatable packer tool comprising:

a flexible tubular packer body radially extendable for contact with a well bore wall and retractable for release from such well bore wall;

means defining a packer set chamber in pressure communicating relation with said packer body whereby said packer body may be radially extended by fluid pressure in said packer set chamber;

an annular upper packer head connected to the upper end of said packer body, said upper packer head defining a chamber inlet for said packer set chamber;

generally annular flow control means disposed at least partially telescopically within said upper packer head for relative longitudinally movement between a first position and a second position, said control means having an inflation port extending generally radially therethrough;

seal means cooperative between said upper packer head and said control means and operative, in said first position, to permit fluid communication between said inflation port and said chamber inlet, and in said second position, to seal said chamber inlet from communication with the interior of said control means;

and a plug ejector adjoined to said upper packer head and disposed in the interior of said upper packer head, adapted to permit flow through the interior of said upper packer head, and having a free end extending upwardly and positioned for telescopic movement with respect to the lower end of said control means upon movement between said first and second positions.

* * * * *